9/16/86 CR 4,612,291

United States Patent [19]

Dawes

[11] Patent Number: 4,612,291

[45] Date of Patent: Sep. 16, 1986

[54] METHOD AND APPARATUS FOR MIXING SERUM AND REAGENTS FOR CHEMICAL ANALYSIS

[75] Inventor: Dennis K. Dawes, Indianapolis, Ind.

[73] Assignee: American Monitor Corporation, Indianapolis, Ind.

[21] Appl. No.: 646,812

[22] Filed: Sep. 4, 1984

[51] Int. Cl.[4] ..... B01F 11/00; B01F 15/02

[52] U.S. Cl. ..... 436/174; 336/127; 422/224; 422/225

[58] Field of Search ..... 366/108, 116, 127, 348, 366/349, 600; 436/174, 179, 183, 826; 422/224, 225

[56] References Cited

U.S. PATENT DOCUMENTS 3,331,589 7/1967 Hammitt et al. ..... 366/116
3,780,992 12/1973 Nishi et al. ..... 366/116

OTHER PUBLICATIONS

Document entitled, "Design Note, Piezoceramics", Piezo Electric Products, Inc., (undated).
Document entitled, "Product Specification, Piezoceramic Thin Sheet", Piezo Electric Products, Inc., (undated).
Document entitled, "Product Specification, Piezoceramic Strain Gauges", Piezo Electric Products, Inc., (undated).
Document entitled, "Product Specification, Piezoceramic Bender Elements", Piezo Electric Products, Inc., (undated).
Document entitled, "Application Note, Piezoceramic Bender Elements", Piezo Electric Products, Inc., (undated).
Document entitled, "Application Note, Soldering Procedures for Piezoceramics", Piezo Electric Products, Inc., (undated).
Document entitled, "Quadrature Fan Module B", Piezo Electric Products, Inc., (undated).
Article entitled, "Piezoelectric Devices", taken from pp. 461–463, of an unknown source.

*Primary Examiner*—Frank Sever
*Attorney, Agent, or Firm*—Willian Brinks Olds Hofer Gilson & Lione

[57] ABSTRACT

Method and apparatus for mixing serum and reagents for chemical analysis. The method comprises the steps of providing a container containing a serum sample and one or more reagents to be mixed, positioning an elongated mixing member within the containers and extending into the serum sample and reagents to be mixed, and then rapidly oscillating the mixing member back and forth along an arcuate path for a sufficient period of time to thoroughly mix the serum sample and reagents. The method reduces foaming of the serum sample-reagent fluid being mixed, helps to eliminate the formation of air bubbles therein and is useful as a degasser to remove air or other gases from serum-reagent mixture. Piezoelectric techniques are employed to effect the mixing with a simple and reliable apparatus. The mixing means includes a driving assembly which comprises a thin, flexible, metal plate having a pair of thin, flexible, piezoceramic elements secured to opposite faces thereof. Upon the application of an A.C. voltage across the piezoceramic elements, the elements will be caused to alternately expand and contract with one element expanding while the other element contracts, causing the free end of the assembly and the mixing blade to oscillate back and forth at a rate determined by the frequency of the applied voltage, e.g., 60 hertz, to mix the serum sample-reagent fluid.

12 Claims, 2 Drawing Figures

METHOD AND APPARATUS FOR MIXING SERUM AND REAGENTS FOR CHEMICAL ANALYSIS

BACKGROUND OF THE INVENTION

The present invention relates to an improved method and apparatus for mixing blood or another body fluid with appropriate reagents in an automatic chemistry-analyzing system, and, more particularly, to such methods and apparatus using piezoelectric phenomena.

The chemical analysis of blood or other body fluids is a vital part of medical diagnosis. Testing for various serum constituents, such as sugar or albumin, for example, or for some other medically significant factor, is generally performed in a manual or automated process by adding specific amounts of various reactive chemicals or reagents to a sample of the serum in a specific sequence and under specified conditions of temperature and time. The light transmittance value of the resulting test chemistry is then measured, and this value can be used to determine the amount of the particular constituent being measured in the serum.

More specifically, in analyzing a serum specimen, a sample of the specimen is typically placed in a test tube or other appropriate container; and one or more specific reagents are added depending on the particular test to be performed. In some cases, the reagents can all be added at once; while in others, an incubation period must take place between the addition of the required reagents. When the required chemical reactions have taken place, a sample of the completed test chemistry is removed from the test tube; and the light transmittance value of the test chemistry is ascertained using a spectrophotometer or the like. This value can be used to calculate the optical density of the chemistry from which the percentage concentration in the serum of the constituent of interest can be ascertained.

A significant portion of the analyses currently conducted on body fluids is now done automatically, and one appropriate automated system is described in detail in U.S. Pat. No. 3,901,656 which is assigned to the same assignee as the present application.

Whether done manually or by an automated system, it is important that the partially completed test chemistries be properly mixed after the addition of each reagent to assure a homogeneous mixture and fully completed reactions that will not give an erroneous result when the chemistries are analyzed. In the system described in the above-mentioned U.S. Pat. No. 3,901,656, mixing is accomplished by positioning a mixing apparatus adjacent to the reagent-dispensing heads which can be extended into the serum-reagent mixture in the test tube. This mixing apparatus comprises a mixing blade coupled to the shaft of a mixer motor which, when actuated, rapidly rotates the mixing blade to combine the mixture and uniformly distributes the reagents throughout.

There are a number of inadequacies in using such a mixing apparatus. For one thing, as is typical in motor mixers, the mixing blade is driven into a rotational motion; and this tends to form a vortex in the liquid being mixed which can pull air bubbles down into the liquid. This is undesirable as the presence of air bubbles can affect the light transmittance value of the test chemistry and give an erroneous result when the chemistries are analyzed. Also, motor mixers sometimes tend to cause foaming on the surface of the liquid which can cause the liquid to spill over the top of the test tube and contaminate other specimens within the system. In addition, in a motor mixer, there is always the possibility of mechanical breakdown as may be caused by broken belts, failed bearings, or the like; and frequently, unacceptable amounts of noise and heat are generated.

SUMMARY OF THE INVENTION

In accordance with the present invention, an improved mixing method and apparatus is provided which avoids the inadequacies described above and provides advantageous mixing characteristics normally not found when using prior mixing methods and apparatus.

The method of the present invention comprises the steps of providing a container containing a serum sample and one or more reagents to be mixed, positioning an elongated mixing member within the container and extending into the serum sample and reagents to be mixed, and then rapidly oscillating the mixing member back and forth along an arcuate path for a sufficient period of time to thoroughly mix the serum sample and reagents and to provide a substantially homogeneous mixture thereof.

The above-described method has advantages that are especially desirable in connection with mixing a serum sample with reagents for analysis. Initially, the method produces an oscillatory mixing motion of the mixing member within the liquid rather than a rotational motion as is typical in the prior art. This has been found to reduce foaming of the liquid. Also, there is a reduction in the formation of air bubbles within the liquid. As indicated above, motor mixers tend to generate a vortex in the liquid that can pull air bubbles down into the liquid. The method of the present invention, on the other hand, has been found to be effective in actually removing gas from the liquid being mixed (i.e., degassing the liquid), which is an important capability not only in the analysis of body fluids but in many other applications as well.

Apparatus to practice the method of the present invention can comprise a container containing the serum sample and one or more reagents to be mixed, and an elongated mixing blade extending into the container and into the serum sample and reagent fluid, and drive means for rapidly oscillating the mixing blade back and forth within the serum and reagent to effect mixing thereof. The drive means, according to a presently preferred embodiments, comprises a pair of thin, flexible piezoelectric elements, preferably piezoceramic elements, secured to opposite faces of a flexible metal strip. The drive means is carried at one end by a support over the container and the mixing blade is attached to the other end to extend into the container. A source of voltage is connected with the two piezoelectric elements, which may be connected in series or in parallel.

When an A.C. voltage is connected with the two elements, the elements will alternately expand and contract with one element being 180° out of phase with respect to the other (i.e., while one is expanding, the other is contracting), causing the drive means assembly to bend first in one direction and then the other at the frequency of the applied voltage (e.g., 60 hertz). The bending back and forth of the assembly, in turn, drives the mixing blade attached to it into rapid oscillation, along an arcuate path, effectively mixing the serum and reagent or other liquid into which it may be inserted.

With the present invention, the amount of mixing desired may be controlled in several ways. Either the frequency, or the level, or both the frequency and level, of the applied voltage can be varied. Also the size of the piezoelectric elements could be changed. In addition, the pitch or angle of the mixing blade relative to the liquid being mixed can be adjusted.

Furthermore, the mixing apparatus according to the present invention can be of very high reliability with a long operating life since it is without frictionally interfitting parts. Motor mixers, on the other hand, and as mentioned above, have belts that can break, bearings and electrical brushes that can fail, can produce excessive heat, and require periodic maintenance and replacement.

In general, the present invention provides a mixing method and apparatus which is particularly adapted for the mixing of small quantities of serum and reagents in a highly effective and reliable manner. Other objects and advantages of the invention will become apparent during the following description of the presently preferred embodiments of the invention taken in conjunction with the drawings.

DETAILED DESCRIPTION OF THE PREFERRED EMBODIMENTS

The method and apparatus of the present invention have been specifically developed for use in connection with automated chemistry analyzing system, and in such an application, a plurality of containers will normally be supported on an appropriate conveyor adapted to carry the containers to positions to receive the serum sample and reagents. In addition, a plurality of mixers may be carried into position over the plurality of containers and lowered into position to mix the contained serum samples and reagents. Such automated systems do not form a part of the present invention and have not been shown and described herein; however, one suitable system is described in detail in previously mentioned U.S. Pat. No. 3,901,656.

Figure 1:
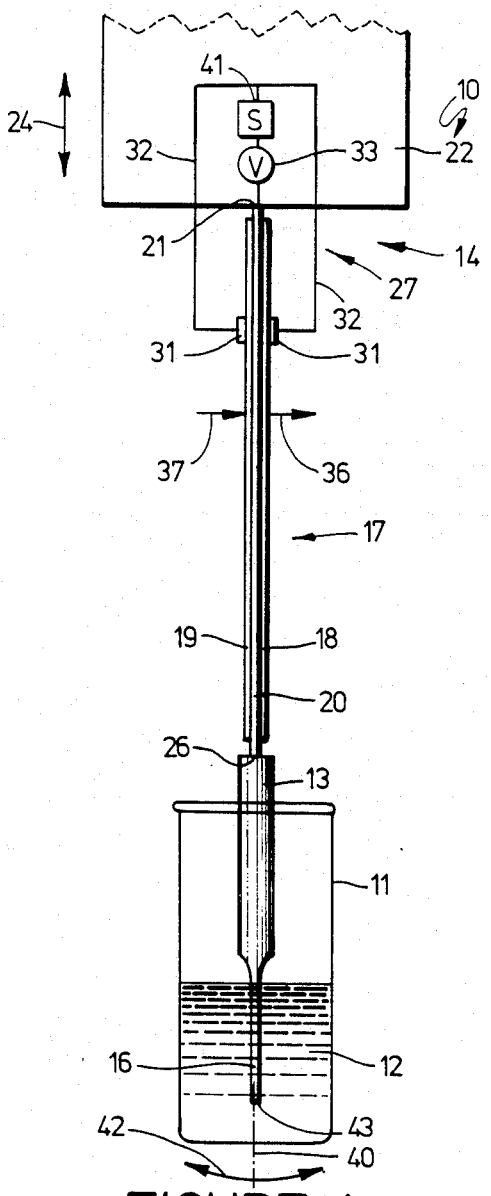
FIG. 1 schematically illustrates a side view of the piezoelectric mixing apparatus according to a presently preferred embodiment for practicing the method of the present invention.
Figure 2:
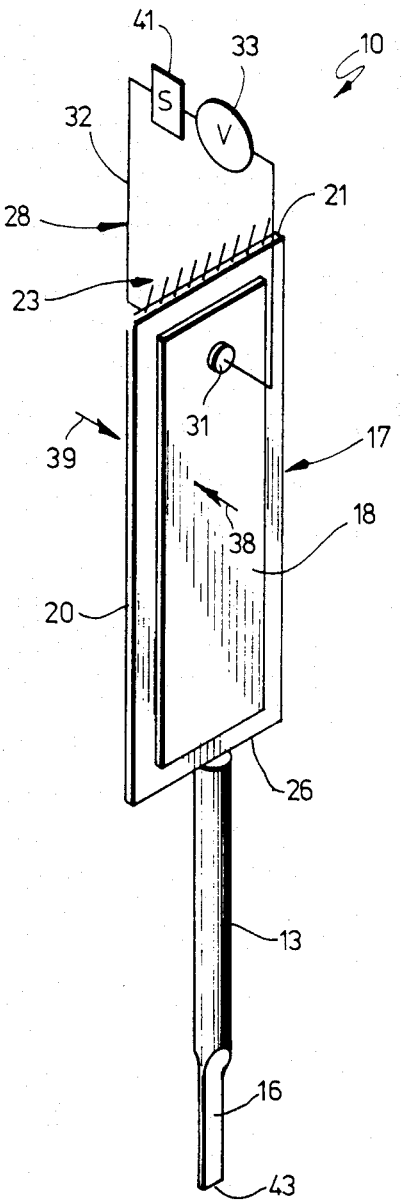
FIG. 2 schematically illustrates a plan view of a portion and alternative embodiment of the mixing apparatus of FIG. 1.

FIGS. 1 and 2 illustrate a presently preferred method and apparatus for practicing the present invention. The apparatus, generally designated by reference numeral 10 includes a container 11 containing a fluid 12 which comprises a serum sample and one or more reagents to be mixed, a mixing member 13 extending into container 11 and into the fluid 12, and drive means 14 for rapidly oscillating the mixing member to mix the serum sample-reagent fluid.

Container 11 preferably comprises an elongated, relatively narrow container such as a test tube or the like, and is adapted to be partially filled with small amounts of a serum sample such as blood or spinal fluid, and one or more specific reagents that will react with the serum sample to provide a test chemistry that can be analyzed to ascertain the percentage concentration of a constituent of interest (e.g., sugar or albumin) in the serum.

The mixing member 13 may take a variety of forms, but it preferably comprises an elongated, relatively rigid mixing blade of stainless steel or the like. Preferably also, member 13 comprises a flattened end portion 16 which is adapted to be extended into the serum sample-reagent fluid to be mixed.

Drive means 14 for oscillating the mixing blade preferably includes an assembly 17 which comprises first and second, thin, flexible, generally rectangular-shaped, piezoelectric elements 18 and 19 secured to opposite faces of a thin flexible metal strip or plate 20. Piezoelectric elements 18 and 19 most preferably comprise piezoceramic elements while metal plate 20 is preferably formed of brass, although it could also be formed of other compliant electrically conductive materials as well.

In the preferred embodiments, piezoelectric elements 18 and 19 comprise piezoceramic sheets having a length of about three-quarters inch, a width of about one-half inch and a thickness of about 1/16 inch or less, although these dimensions can be varied within wide limits. Metal plate 20 preferably has very slightly larger length and width dimensions as compared to the piezoelectric elements and has a thickness that is selected to cooperate with the piezoelectric elements 18 and 19 in driving mixing member 13 within the selected design limits. A typical thickness for this application is 0.022 inch.

The piezoelectric elements must be very securely attached to the metal plate throughout the area of contact between the elements, and this is preferably accomplished by laminating the piezoelectric sheets to the metal plate by a conventional lamination procedure.

The assembly 17 is mounted at its top end 21 to an appropriate frame or support member or to some other appropriate mounting means (represented schematically by housing 22 in FIG. 1 and by lines 23 in FIG. 2) in such a manner that the end 21 of the assembly will be firmly held in a stationary position and not move relative to the support member. Where the mixing apparatus is utilized in a chemistry-analyzing system, support 22 can comprise the piston of an air cylinder or other reciprocating drive means or the like to move the mixing apparatus up and down, as indicated by arrow 24, moving mixing blade 13 into and out of the liquid 12 as needed. The piezoelectric assembly 10 can be attached to the support 22 or 23 in a number of different ways; for example, by clamping it between dielectric supports carried by the housing 22.

Mixing member 13 is attached to the opposite or free end 26 of the assembly 17, preferably by attaching it to the end of metal strip 20 in any convenient manner. Mixing member 13 can be of various shapes and types depending on the particular mixing application; for example, in the preferred embodiment illustrated, it can comprise a mixing blade about two inches long and ⅛ to 3/16 inch wide formed to have a flattened blade portion 16 formed on its outer end.

The mixing apparatus 10 is operated by applying a voltage across the two piezoelectric elements 18 and 19, and this can be done by connecting the two elements either in series or in parallel. FIG. 1 illustrates a parallel connection 27, while FIG. 2 illustrates a series connection 28. Specifically, as shown in the FIGURES, an electrode 31 of silver, nickel, or the like (only one electrode is visible in FIG. 2) is mounted to each element and connected via leads 32 to a voltage source 33. In the preferred embodiment, the voltage source 33 produces an applied A.C. voltage across elements 18, 19 of from about 10 to about 30 volts, 60 hertz, although this can be readily varied. A variable transformer can be provided in the voltage source to vary the applied voltage and, as indicated previously, to control the amount of mixing desired.

In the embodiment illustrated of FIG. 1 wherein the piezoelectric elements are connected in parallel, the elements are designed such that their direction of polarization will be across the width of the elements and in the same direction. Arrows 36 and 37 illustrate one way in which the polarization may be established across the two elements. They could also each be polarized in the opposite direction if desired.

In the embodiment illustrated in FIG. 2 wherein the two piezoelectric elements are connected in series, the direction of polarization across the two elements should be across the width of the elements but in opposite directions, for example, as illustrated by arrows 38 and 39. In all other respects, there will be no difference in the operation of the mixing apparatus with either the series or parallel connection.

A switch illustrated schematically at 41 in the FIGURES, is preferably provided to turn the mixing apparatus on and off; and when actuated, the application of an electric field across the two electrodes will cause one piezoelectric element to expand and the other to simultaneously contract with the result being that the assembly 17 will bend and the free end 26 of the assembly will move at a right angle relative to the assembly axis (shown at 40 in FIG. 1). More particularly, the applied alternating current voltage will cause the piezoelectric elements 18 and 19 to alternately expand and contract with one element expanding while the other is contracting (i.e., the elements will be 180° out of phase with respect to one another). This will cause the free end 26 of the assembly to move back and forth or oscillate at a rate corresponding to the frequency of the applied voltage (60 hertz), which, in turn, will drive the mixing member 13 attached thereto into oscillation at the same rate, along an arcuate path as indicated by arrow 42, to permit mixing of a liquid into which the member is inserted.

The extent of displacement of the free end 26 of the assembly is a function of the transverse charge coefficient of the piezoelectric material, the magnitude of the applied voltage, the length of the assembly, the thickness of the assembly, and whether the connection is series or parallel, according to the equations

| Series Connection | Parallel Connection |
|---|---|
| $X = 2d_{31}VL^2/T^2$ | $X = 4d_{31}VL^2/T^2$ |

where

X=displacement in either direction relative to the axis 40, $d_{31}$=the piezoelectric charge coefficient, L=the length of the piezoelectric elements, and T=the combined thickness of the assembly.

With the preferred embodiments, displacements of end 26 relative to axis 40 of from about 0.006 inch to about 0.015 inch are readily attainable, causing the free end 43 of the mixing member 13 having a length of about two inches to be displaced by from about 0.06 inch to about 0.185 inch relative to axis 40.

In practicing the method according to the present invention, container 11 containing a serum sample and one or more reagents to be mixed is properly positioned relative to the mixing apparatus 10 by carrying means not shown. Housing 22 is them actuated to move the mixing blade downwardly into container 11 and into the serum sample-reagent fluid 12. When the blade is properly positioned switch 41 is actuated to apply voltage across the piezoelectric elements to cause the assembly 17 and the mixing blade 13 to be driven into rapid oscillation to mix the fluid 12. After the serum sample-reagent fluid has been thoroughly mixed, typically less than about six seconds, switch 41 is opened to inactivate the mixing apparatus, and housing 22 is actuated to raise the mixing blade up and out of the container.

The piezoelectric mixing method and apparatus according to the present invention provides several advantages over conventional motor systems.

Initially, it has also been found that the mixing method, according to the present invention provides improved mixing characteristics. Specifically, with the present invention, the mixing blade oscillates back and forth in an arcuate path rather than in a rotational motion as is the case with motor mixers. This has been found to reduce foaming on the surface of the liquid and to help prevent the formation of air bubbles within the liquid. Motor mixers, as indicated previously, have a tendency to form a vortex in the fluid that can pull air bubbles down into the fluid. The present invention, on the other hand, has been found to be quite effective for use in degassing a liquid which is an important capability in many applications.

Also, the mixing apparatus according to the present invention has essentially no moving mechanical parts, such as belts or bearings, that can fail. This makes it extremely reliable and it provide thousands of hours of effective use.

With the present invention, the amount of mixing desired can be varied in one or more ways. The amplitude of the voltage can be changed to change the displacement of the blade. The frequency of the applied voltage can be varied to vary the rate of oscillation of the blade. The size of the piezoelectric elements can be changed, if desired, to change the blade displacement; or the pitch or angle of the mixing blade relative to the fluid can be changed.

Although, in the presently preferred embodiment, the applied voltage is an A.C. voltage, it is also possible to operate the mixer with a switched D.C. voltage.

The mixing method and apparatus of the present invention has been particularly developed for use in mixing a serum sample and one or more reagents in an automated chemistry analyzing system. It should be understood, however, that the apparatus of this invention may be used in many other mixing applications as well.

While what has been described constitute presently most preferred embodiments, it should be understood that various changes and modifications can be made as will be apparent to those skilled in the art. Because such changes and modifications can be made without departing from the spirit and scope of the invention and without diminishing its attendant advantages, it is intended that such changes and modifications be covered by the following claims.

I claim:

1. A method for mixing a serum sample and one or more reagents for chemical analysis comprising providing a container containing a serum sample and one or more reagents to be mixed;

providing a mixing apparatus for mixing said serum sample and said one or more reagents in said container, said mixing apparatus including an assembly comprising a thin, flexible plate having first and second piezoelectric elements attached to opposite faces thereof and having a mixing member attached to one end of said assembly;

positioning said mixing member within said container with at least a portion of said mixing member extending into said serum sample and one or more reagents contained therein; and applying a voltage across said first and second piezeoelectric elements for causing said one end of said assembly and said mixing member attached thereto to oscillate back and forth over a generally arcuate path to mix said serum sample and one or more reagents within said container.

2. A method as recited in claim 1 wherein said positioning step comprises the step of inserting said mixing member into said container and into said serum sample and one or more reagents contained therein, and wherein said method further includes the step of withdrawing said mixing member from said container after said serum sample and one or more reagents have been mixed.

3. A method as recited in claim 2 wherein said oscillating step comprises the step of oscillating said mixing member at a rate of 60 Hertz.

4. Apparatus for mixing a serum sample and one or more reagents in an automated chemistry-analyzing system comprising a container containing a serum sample and at least one reagent to be mixed and mixing means for mixing said serum sample and at least one reagent, said mixing means including a mixing member positioned within said container with at least a portion thereof extending into said serum sample and at least one reagent, and drive means for driving said mixing member into oscillation for mixing said serum sample and at least one reagent, said drive means including:

an assembly including a flexible plate and first and second flexible piezoelectric elements attached to opposite faces of said flexible plate;

support means for supporting one end of said assembly, said mixing member being attached to the opposite end of said assembly; and means for applying a voltage across said first and second piezoelectric elements, said applied voltage causing said first and second piezoelectric elements to alternately expand and contract with said first and second piezoelectric elements expanding and contracting 180° out of phase with respect to one another such that said opposite end of said assembly and said mixing member attached thereto are driven into oscillation along an arcuate path for mixing said serum sample and one or more reagents.

5. Apparatus as recited in claim 4 and further including reciprocating means for inserting said mixing member into said container and into said serum sample and at least one reagent for mixing said serum sample and at least one reagent, and for withdrawing said mixing member from said container after said serum sample and at least one reagent have been mixed.

6. Apparatus as recited in claim 4 wherein said mixing member comprises an elongated mixing blade having a flattened portion extended into said serum sample and at least one reagent to be mixed.

7. Apparatus as recited in claim 4 wherein said first and second piezoelectric elements comprise first and second piezoceramic elements and wherein said flexible plate comprises a bronze plate.

8. Apparatus as recited in claim 7 wherein said first and second piezoceramic elements each comprise generally rectangular-shaped piezoceramic plates having a thickness of a small fraction of an inch, a length in the direction extending from said one end of said assembly to said opposite end of said assembly of about three-quarters inch, and a width of about one-half inch.

9. Apparatus as recited in claim 4 wherein said means for applying a voltage comprises means for applying an A.C. voltage of from about 10 volts, 60 hertz to about 30 volts, 60 hertz.

10. Apparatus as recited in claim 4 wherein said first and second piezoelectric elements are connected in series and wherein the directions of polarization of said elements are in opposite directions across the thickness of said elements.

11. Apparatus as recited in claim 4 wherein said first and second piezoelectric elements are connected in parallel and wherein the directions of polarization of said elements are in the same direction across the thickness of said elements.

12. An automated chemistry-analyzing system comprising an elongated container containing a serum sample and one or more reagents to be mixed, and mixing means for mixing said serum sample and said one or more reagents, said mixing means including:

an assembly including first and second flexible pizeoelectric elements mounted to opposite faces of a flexible metal plate;

a mixing blade attached to one end of said assembly and extending outwardly therefrom;

reciprocating drive means attached to the opposite end of said assembly, said reciprocating drive means including means for moving said mixing blade into said container for mixing said serum sample and said one or more reagents therein, and for withdrawing said mixing blade from said container following the mixing thereof, said opposite end of said assembly being firmly mounted to said drive means to be maintained stationary with respect thereto; and means for applying a voltage across said first and second piezoeletric elements, the direction of polarization across each of said first and second piezoelectric elements being chosen such that said first and second piezoelectric elements will alternately expand and contract 180° out of phase with respect to one another to drive said one end of said assembly and said mixing blade attached thereto into rapid oscillation along an arcuate path for mixing said serum sample and said one or more reagents within said elongated container.

* * * * *

UNITED STATES PATENT AND TRADEMARK OFFICE

CERTIFICATE OF CORRECTION

PATENT NO. : 4,612,291

DATED : SEPTEMBER 16, 1986

INVENTOR(S) : DENNIS K. DAWES

It is certified that error appears in the above-identified patent and that said Letters Patent is hereby corrected as shown below:

In col. 2, line 50, delete "embodiments" and insert -- embodiment -- therefor.

In col. 3, line 38, delete "system," and insert -- systems, -- therefor; line 53, after "10", insert -- , --.

In col. 5, line 4, delete "of" and insert -- in --; line 20, after "switch" insert -- , --.

In col. 6, line 3, after "positioned", insert -- , --; line 15, after "invention", insert -- , --; line 31, delete "provide" and insert -- provides -- therefor.

Signed and Sealed this

Sixteenth Day of December, 1986

*Attest:*

DONALD J. QUIGG

*Attesting Officer* *Commissioner of Patents and Trademarks*